US011105059B2

(12) United States Patent
Gilot

(10) Patent No.: US 11,105,059 B2
(45) Date of Patent: Aug. 31, 2021

(54) SNOW MELTING MAT

(71) Applicant: Jose Gilot, Jamestown, NY (US)

(72) Inventor: Jose Gilot, Jamestown, NY (US)

( * ) Notice: Subject to any disclaimer, the term of this patent is extended or adjusted under 35 U.S.C. 154(b) by 380 days.

(21) Appl. No.: 16/223,910

(22) Filed: Dec. 18, 2018

(65) Prior Publication Data

US 2020/0190757 A1 Jun. 18, 2020

(51) Int. Cl.

| | |
|---|---|
| ***E01H 5/10*** | (2006.01) |
| ***H05B 3/06*** | (2006.01) |
| ***H05B 3/28*** | (2006.01) |
| ***H05B 3/36*** | (2006.01) |
| ***H05B 3/20*** | (2006.01) |

(52) U.S. Cl.

CPC ..... *E01H 5/10* (2013.01); *H05B 3/06* (2013.01); *H05B 3/20* (2013.01); *H05B 3/36* (2013.01); *H05B 2203/016* (2013.01); *H05B 2214/02* (2013.01)

(58) Field of Classification Search

None

See application file for complete search history.

(56) References Cited

U.S. PATENT DOCUMENTS 4,967,057 A * 10/1990 Bayless ..... H05B 3/36 219/213
5,591,365 A * 1/1997 Shields ..... E01C 11/265 219/213
5,763,858 A * 6/1998 Jones ..... B64D 15/22 219/213
5,804,799 A * 9/1998 Stewart ..... H05B 3/34 219/202
6,184,496 B1 * 2/2001 Pearce ..... E01C 11/265 219/202
6,211,493 B1 * 4/2001 Bouman ..... E01C 11/265 219/213
6,278,085 B1 * 8/2001 Abukasm ..... E01C 11/265 219/213
6,294,768 B1 * 9/2001 Liebich ..... H05B 3/36 119/526
6,943,320 B1 * 9/2005 Bavett ..... H05B 3/34 219/213
6,963,049 B1 * 11/2005 Martin ..... B60L 1/02 219/202

(Continued)

FOREIGN PATENT DOCUMENTS

DE 10052345 A1 * 5/2002 ..... F24D 13/022
KR 20130029540 A * 3/2013

*Primary Examiner* — Joseph M. Pelham
(74) *Attorney, Agent, or Firm* — The Iwashko Law Firm, PLLC; Lev Ivan Gabriel Iwashko

(57) ABSTRACT

A snow melting mat, including at least one main body that disperses heat throughout the surface of the at least one main body, at least one groove disposed on the surface of the at least one main body to prevent a user from slipping, at least one plug disposed on the at least one main body that is removably attached to at least one side of the at least one main body, at least one socket disposed on the at least one main body that is removably attached to at least one side of the at least one main body, such that the at least one plug is connected to the at least one socket, and a mesh of heating cables disposed within the at least one main body to provide heat to the at least one main body.

6 Claims, 4 Drawing Sheets

(56) References Cited

U.S. PATENT DOCUMENTS

| | | | | |
|---|---|---|---|---|
| 8,076,619 | B1 * | 12/2011 | Wingale | H05B 3/34 219/528 |
| 9,353,487 | B1 * | 5/2016 | Szekely | E01C 5/22 |
| 10,718,091 | B1 * | 7/2020 | Wesley | H05B 3/28 |
| 10,767,322 | B1 * | 9/2020 | Heiligenstein | F25D 21/006 |
| 10,920,379 | B2 * | 2/2021 | Naylor | H05B 3/36 |
| 2004/0035853 | A1 * | 2/2004 | Pais | E01C 11/265 219/548 |
| 2004/0099654 | A1 * | 5/2004 | Pais | H05B 3/36 219/486 |
| 2006/0137280 | A1 * | 6/2006 | Bartnes | E04F 15/04 52/582.2 |
| 2008/0261464 | A1 * | 10/2008 | Oosterling | H05B 3/36 439/884 |
| 2009/0050617 | A1 * | 2/2009 | Paris | H05B 3/36 219/213 |
| 2012/0168427 | A1 * | 7/2012 | Chang | F24D 13/02 219/528 |
| 2016/0014847 | A1 * | 1/2016 | Jeong | F24D 19/1096 219/509 |
| 2016/0100457 | A1 * | 4/2016 | Cole | E01H 5/10 219/213 |
| 2017/0027024 | A1 * | 1/2017 | Oloko | H05B 3/342 |
| 2017/0335523 | A1 * | 11/2017 | Moussa | H05B 3/286 |
| 2019/0024325 | A1 * | 1/2019 | Dong | E01C 9/083 |
| 2019/0090313 | A1 * | 3/2019 | Jones, Sr. | H05B 3/06 |
| 2019/0263361 | A1 * | 8/2019 | Carroll | B60S 1/66 |
| 2021/0079613 | A1 * | 3/2021 | Jones, Sr. | E01H 5/108 |

* cited by examiner

SNOW MELTING MAT

BACKGROUND

1. Field

The present general inventive concept relates generally to a mat, and particularly, to a snow melting mat.

2. Description of the Related Art

In winter, many people are generally concerned with safety due to inclement weather. Specifically, people are confronted with snow or ice accumulation on walkways and driveways. Furthermore, people need to determine the best methods for keeping pavements, driveways, and sidewalks snow-free and ice-resistant while minimizing labor. Currently, consumers rely on snow blowers to assist in managing snowfall, but this option still requires having a user brave the cold weather and to invest in gas to power the blower.

Therefore, there is a need for a way to remove snow and ice in a more convenient manner.

SUMMARY

The present general inventive concept provides a snow melting mat.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a snow melting mat, including at least one main body that disperses heat throughout the surface of the at least one main body, at least one groove disposed on the surface of the at least one main body to prevent a user from slipping, at least one plug disposed on the at least one main body that is removably attached to at least one side of the at least one main body, at least one socket disposed on the at least one main body that is removably attached to at least one side of the at least one main body, such that the at least one plug is connected to the at least one socket, and a mesh of heating cables disposed within the at least one main body to provide heat to the at least one main body.

The snow melting mat may further include at least one sensor disposed within the at least one main body to detect at least one of a living person, animal, snow, and ice.

The at least one sensor detects the approach of a living person or animal and immediately deactivates heat from a portion of the at least one main body.

The at least one sensor activates or deactivates the mesh based on detected contact of new snow or ice.

The at least one sensor activates or deactivates the mesh based on a timer.

The at least one sensor uses a timer to activate or deactivate the mesh.

A mat holder, including at least one frame disposed on a surface to support and prevent movement of a snow melting mat, at least one exterior side of the at least one frame that contacts the surface, at least one interior side disposed within the at least one frame such that the snow melting mat is placed onto the at least one interior side, and an open channel disposed on at least one interior side and another at least one interior side, such that it has substantially the same shape as the at least one frame.

The at least one frame has at least one of an L-shape or Z-shape.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further, understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
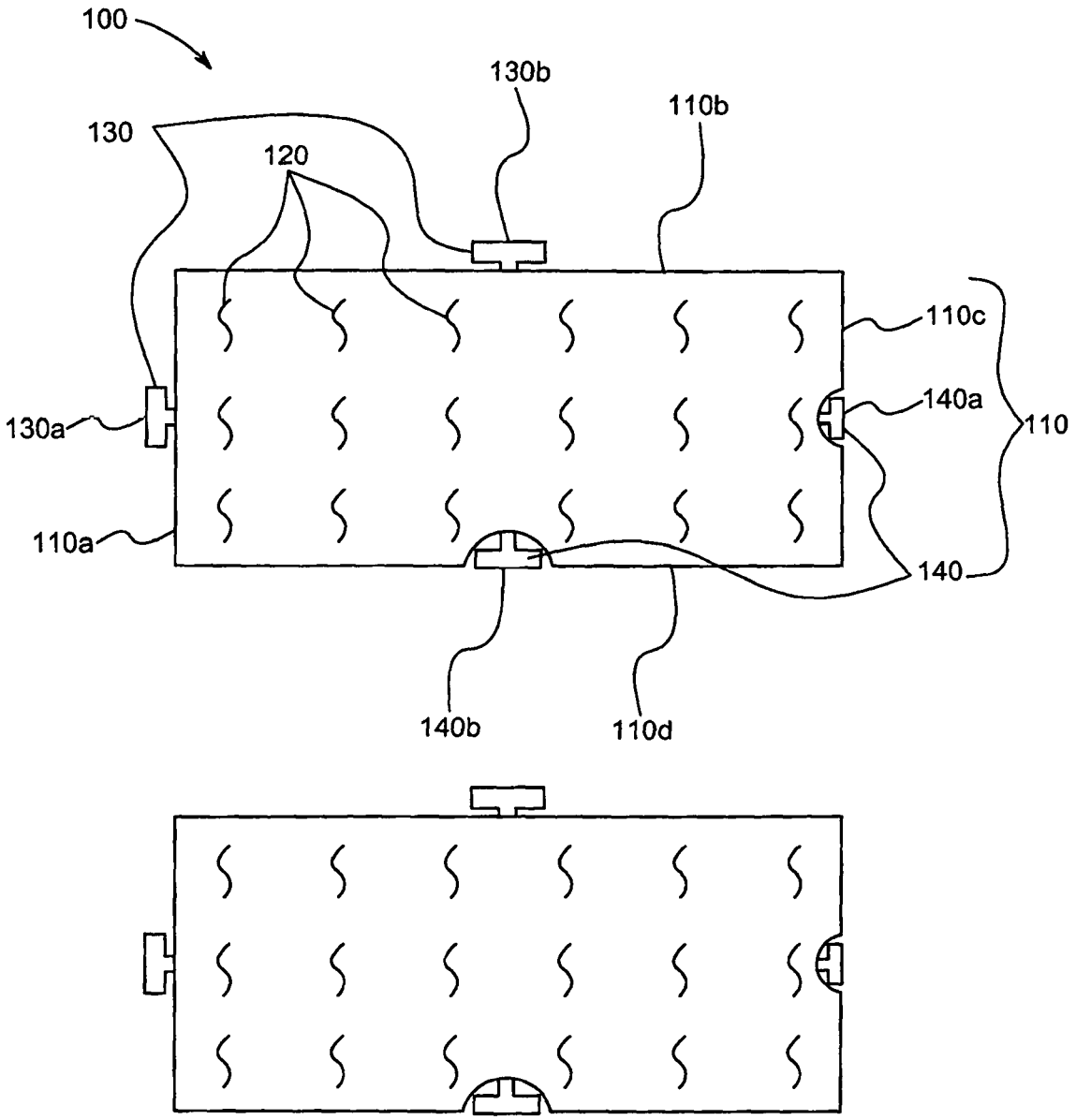
FIG. 1 illustrates a top view of a snow melting mat, according to an exemplary embodiment of the present general inventive concept.

FIG. 1 illustrates a top view of a snow melting mat 100, according to an exemplary embodiment of the present general inventive concept.

The snow melting mat 100 may include at least one main body 110, but is not limited thereto. The at least one main body 110 may be constructed from vulcanized rubber, polybenzimidazole fiber, polypropylene, coated nylon, fire-resistant cotton, wool, etc., but is not limited thereto. The at least one main body 110 may be substantially flat in structure. Although, the at least one main body 110 is illustrated in FIG. 1 to have a rectangular prism shaped, the at least one main body 110 may be rectangular, circular, conical, or any feasible shape desired by a user. The at least one main body 110 may withstand a continuous temperature of 50° F. to 275° F. and withstand intermitted temperatures of 74° F. to 300° F. The at least one main body 110 may have a length in a range of 12 to 16 feet long and a width of 3.5 feet long.

The at least one main body 110 may include a first side 110*a*, a second side 110*b*, a third side 110*c*, a fourth side 110*d*, at least one groove 120, a first plug 130*a*, a second plug 130*b* (collectively, a pair of plugs 130), a first socket 140*a*, a second socket 140*b* (collectively, a pair of sockets 140), and at least one sensor 160. The first side 110*a* and the second side 110*b* may have the first plug 130*a* and the second plug 130*b*, respectively, disposed thereon. The third side 130*c* and the fourth side 140*c* may have the first socket 140*a* and the second socket 140*b*, respectively, disposed thereon. The pair of plugs 130 and the pair of sockets 140 may be removably attached and interchangeable. In other words, the first side 110*a* and the second side 110*b* may be adapted to have the second socket 140*b* and the first plug 130*a*, respectively, disposed thereon, while the third side 110*c* and the fourth side 110*d* may have the first socket 140*a* and the second plug 130*b*, respectively, disposed thereon. Moreover, the at least one main body 110 can be flipped over without any change in function or appearance.

The at least one groove 120 may be disposed throughout a surface of the at least one main body, such that the user will not slip and fall, during contact with the at least one main body 110. The at least one sensor 160 may be disposed within the at least one main body 110 at any feasible location. The at least one sensor 160 may detect the approach of living person or animal and, thereby, immediately deactivate heat from that portion of the at least one main body 110 nearest to that living person or animal.

Figure 2:
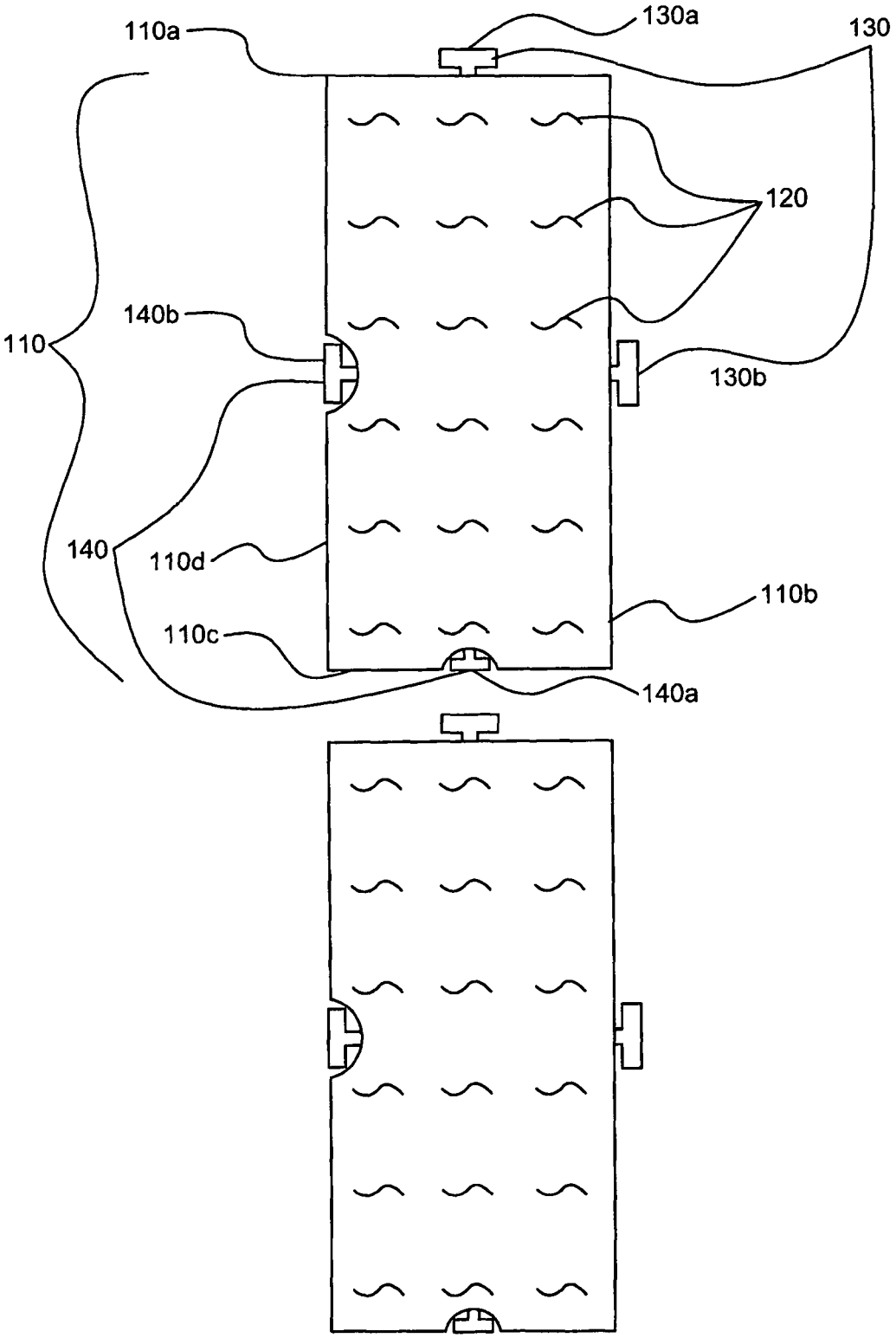
FIG. 2 illustrates a top view of the snow melting mat, according to an exemplary embodiment of the present general inventive concept.

FIG. 2 illustrates a top view of the snow melting mat 100, according to an exemplary embodiment of the present general inventive concept.

Figure 3:
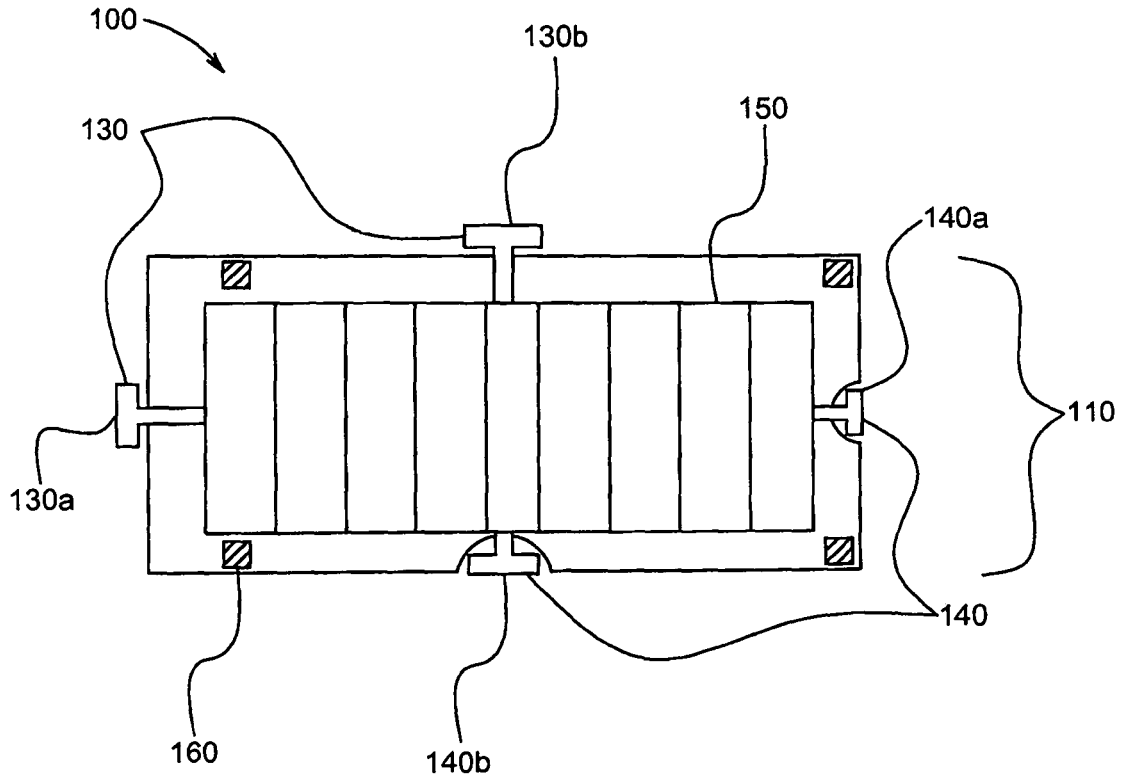
FIG. 3 illustrates an internal view of the snow melting mat, according to an exemplary embodiment of the present general inventive concept.

FIG. 3 illustrates an internal view of the snow melting mat 100, according to an exemplary embodiment of the present general inventive concept.

Referring to FIGS. 1 and 2, the at least one main body 110 may be laid on any surface, including a walkway, a sidewalk, a stairwell, and a driveway, etc., but is not limited thereto. The at least one main body 110 may be oriented on the surface in a variety of configurations such that the first plug 130*a* or the second plug 130*b* may be directed toward the first socket 140*a* or the second socket 140*b* on another at least one main body 110. The first plug 130*a* or the second plug 130*b* may be physically and electrically connected to the first socket 140*a* or the second socket 140*b* on another at least one main body 110. The interconnected arrangement of the at least one main body 110 may allow the user to substantially cover the surface the user intends to clear of snow and/or ice.

Referring to FIG. 3, the at least one main body 110 may include a mesh 150 of heating cables. The mesh 150 may operate at low or high voltage, be very flexible, and be waterproof, but is not limited thereto. The mesh 150 may be physically and electrically connected to the pair of plugs 130 and the pair of sockets 140. The mesh 150 may provide heat throughout the surface of the at least one main body 110, which causes snow and/or ice to melt. Furthermore, the at least one sensor 160 may activate or deactivate the mesh 150 based on detected contact of new snow or ice. Additionally, the at least one sensor 160 may activate or deactivate the mesh 150 using a timer.

Figure 4:
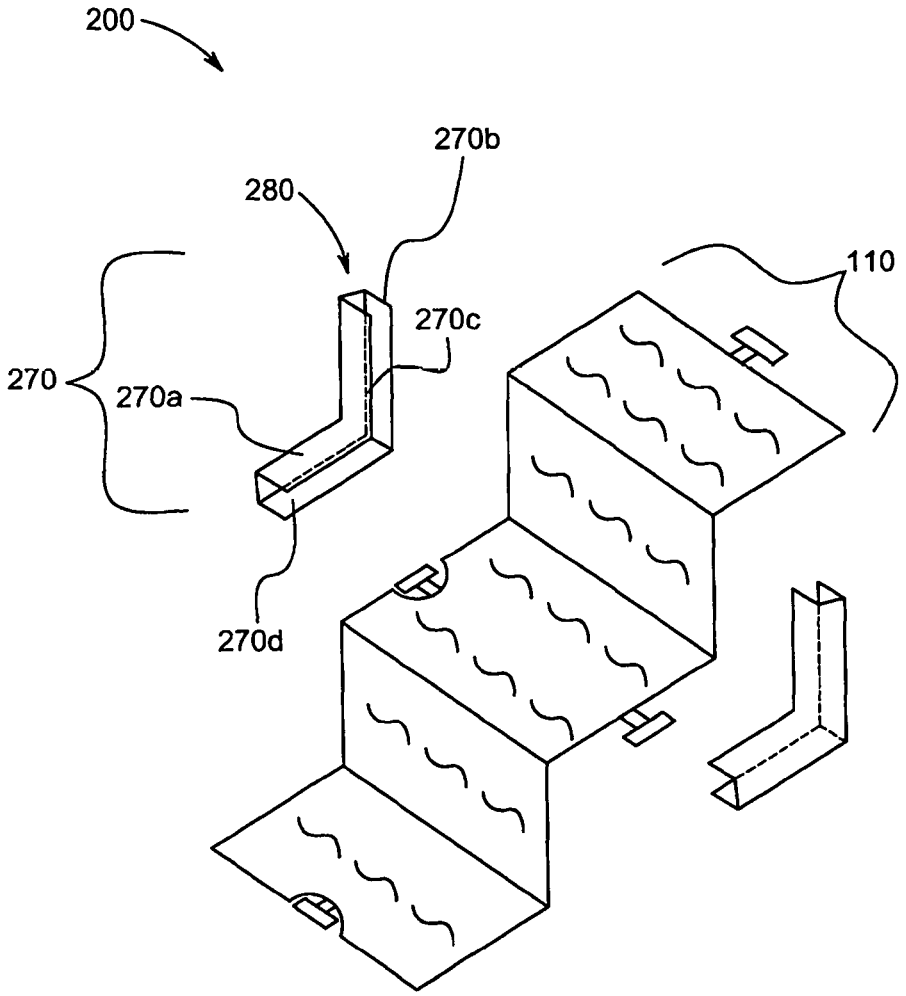
FIG. 4 illustrates side view of a mat holder, according to another exemplary embodiment of the present general inventive concept.

FIG. 4 illustrates side view of a mat holder 200, according to another exemplary embodiment of the present general inventive concept.

The mat holder 200 may include at least one frame 270. The at least one frame 270 may be constructed from at least one of aluminum, titanium, steel, wood, plastic, stone, ceramic, closed-cell extruded polystyrene foam, etc., but is not limited thereto.

The at least one frame 270 may include a first exterior side 270*a*, a second exterior side 270*b*, a first interior side 270*c*, a second interior side 270*d*, and an open channel 280.

Referring to FIG. 4, the at least one frame 270 may be disposed on any surface to support the at least one main body 110. Although, the at least one frame 270 is illustrated in FIG. 4 to have an L-shape, the at least one frame 270 may be Z-shaped, rectangular, circular, conical, or any feasible shape desired by a user. Furthermore, the second exterior side 270*b* may be oriented to contact any surface. The open channel 280 may be disposed between the first interior side 270*c* and the second interior side 270*d*. The open channel 280 may be substantially of the same shape as the at least one frame 270. Consequently, a portion of the at least one main body 110 may be disposed onto the second interior side 270*d*, by sliding the at least one main body 110 into the at least one frame 270 using the open channel 280. Specifically, the at least one main body 110 may be placed onto the second interior side 270*d*. As such, the at least one frame 270 may prevent the at least one main body 110 from movement.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A snow melting mat, comprising:

at least one main body that disperses heat throughout the surface of the at least one main body;

at least one groove disposed on the surface of the at least one main body to prevent a user from slipping;

at least one plug disposed on the at least one main body that is removably attached to at least one side of the at least one main body and protrudes a distance away from at least one side of the main body;

at least one socket disposed on the at least one main body that is removably attached to at least one side of the at least one main body, such that the at least one plug is connected to another at least one socket disposed on another at least one main body, such that the at least one plug is removably attached to at least one side of the at least one main body in absence of the at least one socket; and a mesh of heating cables disposed within the at least one main body to provide heat to the at least one main body.

2. The snow melting mat of claim 1, further comprising:

at least one sensor disposed within the at least one main body to detect at least one of a living person, animal, snow, and ice.

3. The snow melting mat of claim 2, wherein the at least one sensor detects the approach of a living person or animal and immediately deactivates heat from a portion of the at least one main body.

4. The snow melting mat of claim 2, wherein the at least one sensor activates or deactivates the mesh based on detected contact of new snow or ice.

5. The snow melting mat of claim 2, wherein the at least one sensor activates or deactivates the mesh based on a timer.

6. The snow melting mat of claim 2, wherein the at least one sensor uses a timer to activate or deactivate the mesh.

* * * * *